US006915542B1

(12) United States Patent
Lin

(10) Patent No.: US 6,915,542 B1
(45) Date of Patent: Jul. 12, 2005

(54) SWEEPING AND WRINGING APPARATUS

(76) Inventor: Ming-Hsien Lin, No. 13, Hun Yi St., Pu Tzi Chen Ind, Dist. Chia Yi Hsien (TW)

( * ) Notice: Subject to any disclaimer, the term of this patent is extended or adjusted under 35 U.S.C. 154(b) by 0 days.

(21) Appl. No.: 10/828,853

(22) Filed: Apr. 19, 2004

(51) Int. Cl.[7] ..... A47L 13/144
(52) U.S. Cl. ..... 15/119.2
(58) Field of Search ..... 15/119.1, 119.2, 15/116.1, 116.2

(56) References Cited

U.S. PATENT DOCUMENTS 2,203,106 A * 6/1940 Miller ..... 15/119.2
2,235,264 A * 3/1941 Miller ..... 15/119.2
2,651,069 A * 9/1953 Hoffman ..... 15/119.2
4,491,998 A * 1/1985 Wilson et al. ..... 15/119.2
5,097,561 A * 3/1992 Torres ..... 15/119.2
5,438,727 A * 8/1995 Specht ..... 15/119.2
5,606,760 A * 3/1997 De Guzman ..... 15/119.2
6,026,530 A * 2/2000 Camp, Jr. ..... 15/119.2
6,341,401 B1 * 1/2002 Lin ..... 15/119.2
2004/0016072 A1 * 1/2004 Libman et al. ..... 15/116.2

* cited by examiner

*Primary Examiner*—Gary K. Graham
(74) *Attorney, Agent, or Firm*—Pro-Techtor International Services

(57) ABSTRACT

A sweeping and wringing apparatus comprises a cleaning head, a squeezing head, a main rod, a wringing rod, two connecting rods, two transverse bars, and two squeezers. The two transverse bars are symmetrically fastened to front and rear parts of the squeezing head at a fixed mutual distance. A plurality of squeezing sections is put excentrically over the transverse bars, forming two lines. When the cleaning head is pulled up to be wrung, passing through between the two lines of squeezers, the squeezers turn, with a gap in between gradually becoming narrower as the cleaning head moves upward, resulting in effective wringing of the cleaning head.

3 Claims, 9 Drawing Sheets

SWEEPING AND WRINGING APPARATUS

BACKGROUND OF THE INVENTION

1. Field of the Invention

The present invention relates to a sweeping and wringing apparatus, particularly to a sweeping and wringing apparatus having excentrically mounted sweepers with round cross-sections for wringing a cleaning element and an enlarged working surface, allowing a user to perform wringing more effectively and easily and allowing the cleaning head after wringing readily to revert to a previous shape for continued sweeping.

2. Description of Related Art

As shown in FIGS. 12 and 13, a conventional sweeping and wringing apparatus comprises: a cleaning head 1, a squeezing head 2, a main rod 3, a U-shaped wringing rod 4, two connecting rods 5, two transverse bars 6*a*, and two squeezers 57. The cleaning head 1 has a base plate 11 and a cleaning element 12 and is used for sweeping a floor. The squeezing head 2 is placed on an upper side of the cleaning head 1, partly surrounding the cleaning head 1 in the shape of the inverted letter U, and has an upper part, having a fastening hole 21 and two sides with openings 22, and downward extending front and rear parts, each of which have a left arm 23*a* and a right arm 24*a* further extending downward, enclosing an opening 27. Through holes 25*a*, 26*a* are bored through the left and right arms 23*a*, 24*a*, respectively. The main rod 3 is mounted on the fastening hole 21 of the squeezing head 2 and serves as a hold during sweeping. The wringing rod 4 is on two ends thereof hingedly connected with the main rod 3 at a middle section thereof and has an outward-reaching middle section with a grip 41, facilitating pulling up of the wringing rod 4. The two connecting rods 5 are symmetrically disposed along two lateral sides of the main rod 3, having upper ends that are hingedly connected with the wringing rod 4 and lower ends that respectively pass through the openings 22 and are fastened to the base plate 11 of the cleaning head 1. The two connecting rods 5 are moved upward by pulling up of the wringing rod 4, in turn pulling the cleaning head 1 upward. The two transverse bars 6*a* are respectively mounted on the front and rear parts of the squeezing head 2, each passing through the through holes 25*a*, 26*a* of the left and right arms 23*a*, 24*a*. The two squeezers 57 are respectively set on the two transverse bars 6*a*, leaving a gap in between. When the cleaning element 12 enters the gap between the two squeezers 57, water contained therein is squeezed out.

For wringing the cleaning head 1, the user holds the main rod 3 with one hand and, with the other hand holding the grip 41, pushes up the wringing rod 4, so that the two connecting rods 5 pull up the base plate 11, taking along the cleaning element 12. The cleaning element 12, having entered the gap between the two squeezers 57, is compressed, and water contained therein is squeezed out. After the cleaning element 12 has been wrung, the two connecting rods 5 are pushed down to an original position, in turn pushing down the cleaning element 12 to an original position. Repeated pushing up and down of the wringing rod 4 brings about complete wringing of the cleaning element 12.

There are, however, shortcomings. In a conventional sweeping and wringing apparatus the squeezers 57 are concentrically mounted tubes with a gap of constant width in between. The squeezers 57 have relatively small working surfaces where water is squeezed out of the cleaning element 12, so that the cleaning element 12 is easily damaged. After wringing, the cleaning element 12 readily sucks up water again. Furthermore, the cleaning element 12 after wringing does not easily return to an original shape thereof. Therefore, a conventional sweeping and wringing apparatus still has many shortcomings.

SUMMARY OF THE INVENTION

It is an object of the present invention to provide a sweeping and wringing apparatus which allows effectively to be wrung and is convenient to use.

Another object of the present invention is to provide a sweeping and wringing apparatus with a cleaning had which after wringing readily returns to an original shape thereof.

The present invention can be more fully understood by reference to the following description and accompanying drawings.

DETAILED DESCRIPTION OF THE PREFERRED EMBODIMENTS

Figure 1:
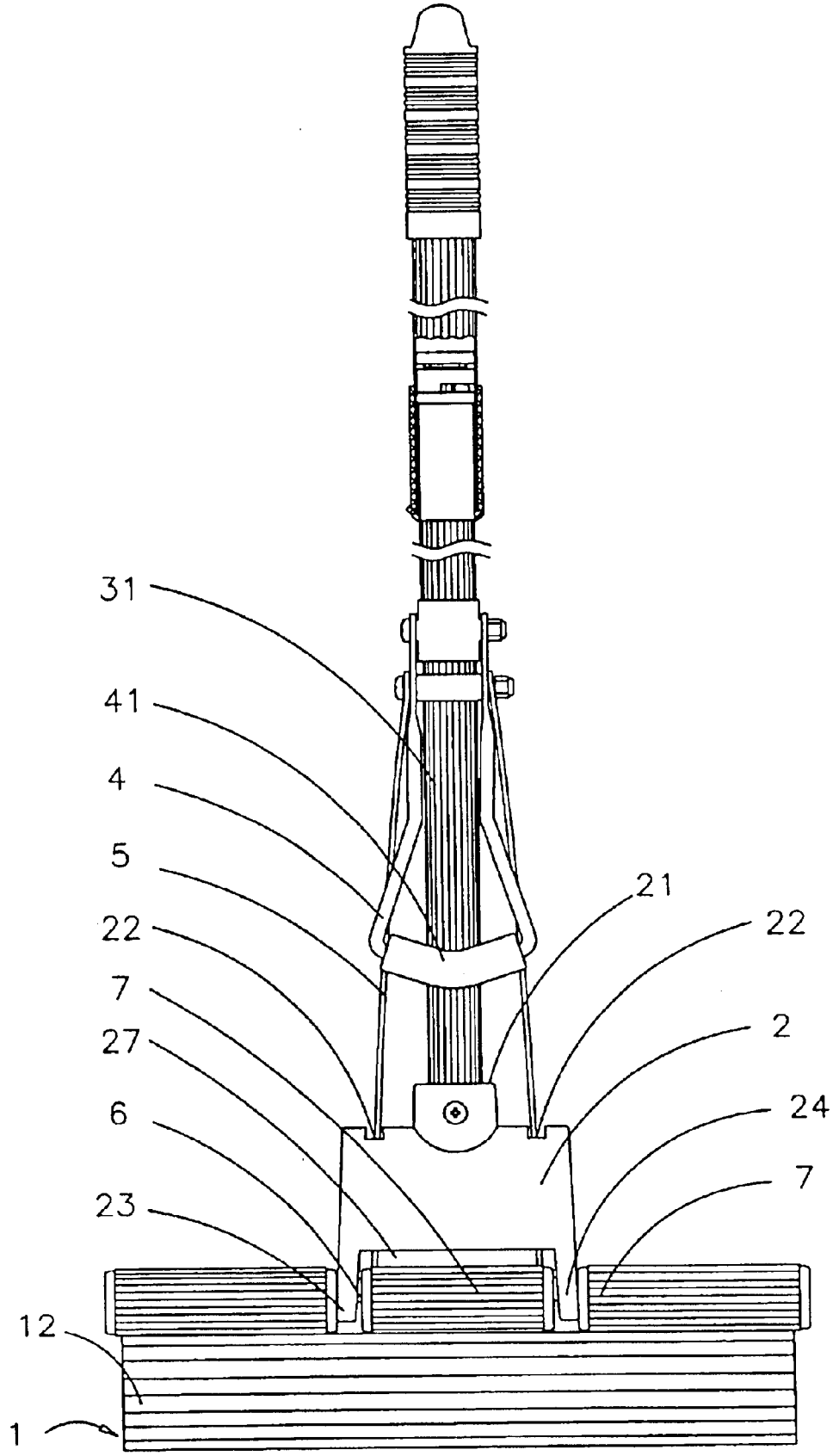
FIG. 1 is a front view of the sweeping and wringing apparatus of the present invention.
Figure 2:
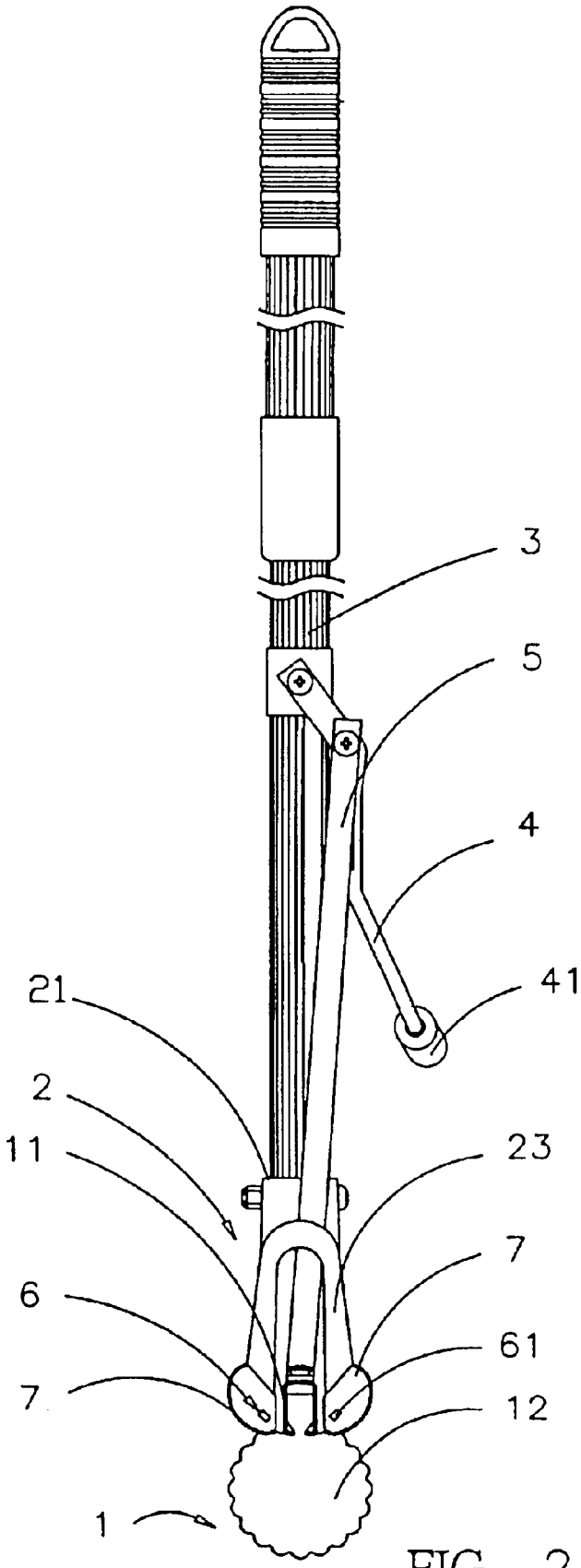
FIG. 2 is a side view of the sweeping and wringing apparatus of the present invention.

As shown in FIGS. 1 and 2, the sweeping and wringing apparatus of the present invention comprises: a cleaning head 1, a squeezing head 2, a main rod 3, a U-shaped wringing rod 4, two connecting rods 5, two transverse bars 6, and two squeezers 7. The two transverse bars 6 serve to wring the cleaning head 1 and are mounted on a lower side of the squeezing head 2 at a fixed distance from each other. The two squeezers 7 are respectively set on the two transverse bars 6, wringing the cleaning head 1 while turning. When being pulled upward, the cleaning head 1 enters a gap between two squeezers 7, is compressed, and water contained therein is squeezed out. Below, a more detailed explanation is given.

The cleaning head 1 has a base plate 11 and a cleaning element 12, mounted below the base plate 11, with the base plate 11 partly surrounding the cleaning element 12 from above. The cleaning element 12 is used for sweeping a floor.

The squeezing head 2 is placed on an upper side of the cleaning head 1, partly surrounding the cleaning head 1 in the shape of the inverted letter U, and has an upper part with a fastening hole 21.

The main rod 3 is mounted on the fastening hole 21 of the squeezing head 2 and serves as a hold during sweeping.

The wringing rod 4 is on two ends thereof hingedly connected with the main rod 3 at a middle section thereof and has an outward-reaching middle section with a grip 41, facilitating pulling up of the wringing rod 4.

The two connecting rods 5 are symmetrically disposed along two lateral sides of the main rod 3, having upper ends that are hingedly connected with the wringing rod 4 and lower ends that are fastened to the base plate 11 of the cleaning head 1. The two connecting rods 5 are moved upward by pulling up of the wringing rod 4, in turn pulling the cleaning head 1 upward.

The two transverse bars 6 are respectively mounted on front and rear parts of the squeezing head 2 at a fixed distance from each other.

The two squeezers 7 are respectively set on the two transverse bars 6, leaving a gap in between. When the cleaning element 12 enters the gap between the two squeezers 7, the two squeezers 7 are turned and water contained therein is squeezed out. The two squeezers 7 are excentrically set on the two transverse bars 6, having curved contact surfaces for wringing.

For wringing the cleaning element 12, a user holds the main rod 3 with one hand and, with the other hand holding the grip 41, pushes up the wringing rod 4, so that the two connecting rods 5 pull up the base plate 11, taking along the cleaning element 12. The cleaning element 12, having entered the gap between the two squeezers 7, is compressed, and water contained therein is squeezed out.

Figure 3:
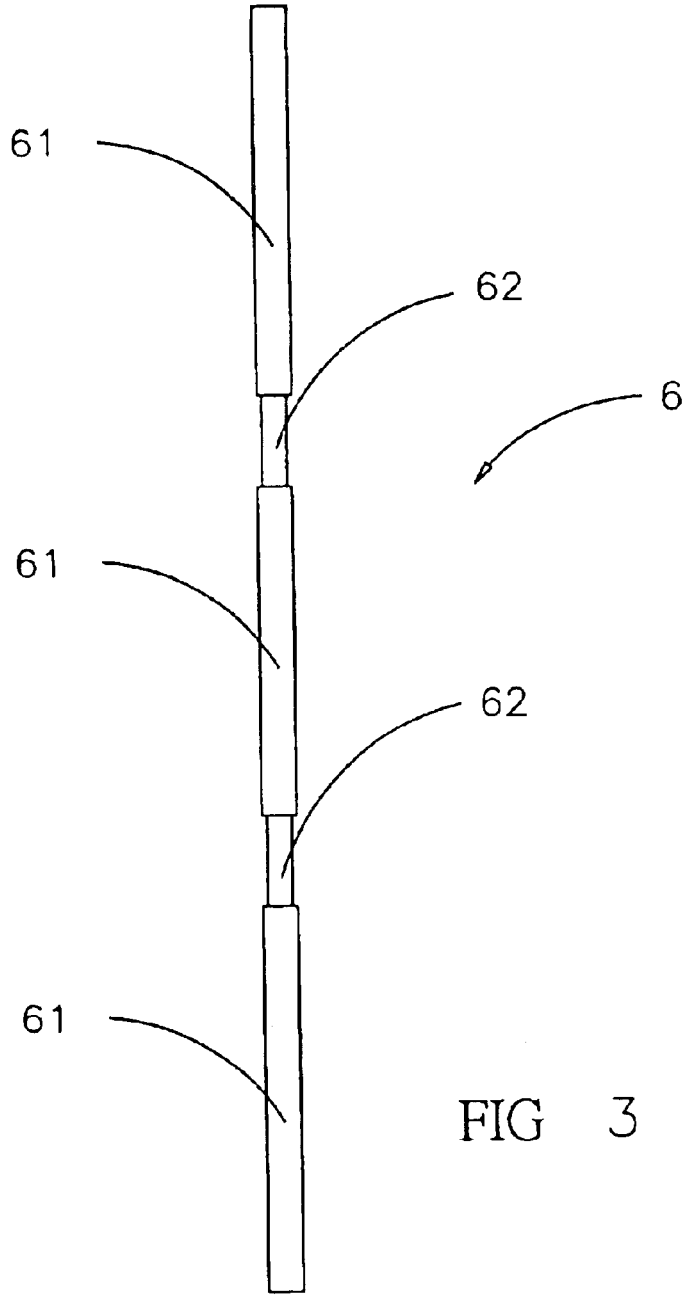
FIG. 3 is a side view of one of the transverse bars of the present invention.
Figure 4:
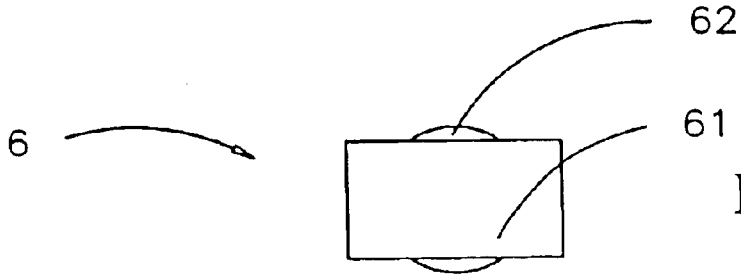
FIG. 4 is a cross-sectional view of one of the transverse bars of the present invention.

Referring to FIGS. 3 and 4, each of the transverse bars 6 comprises three engaging sections 61 with rectangular cross-sections and two smooth sections 62 with circular cross-sections, each placed between two engaging sections 62.

Figure 5:
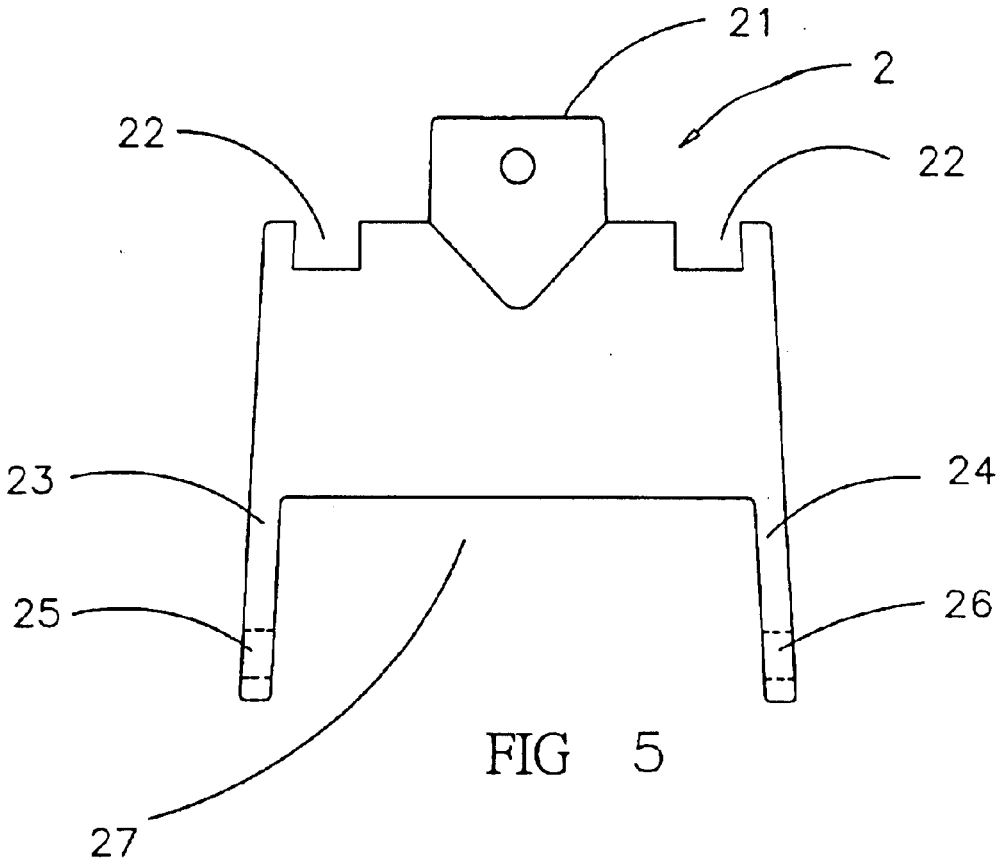
FIG. 5 is a front view of the squeezing head of the present invention.
Figure 6:
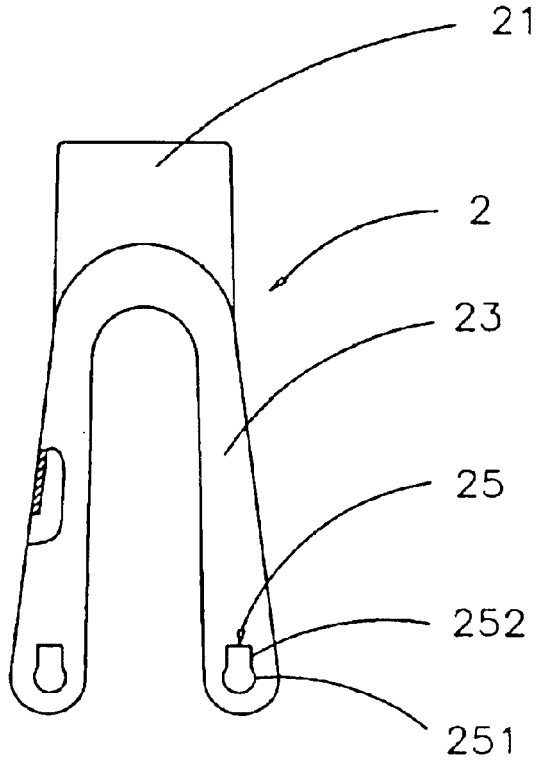
FIG. 6 is a side view of the squeezing head of the present invention.

Referring to FIGS. 5 and 6, the squeezing head 2 is shaped like the inverted letter U, with a front part and a rear part. The fastening hole 21 on the upper part of the squeezing head 2 takes in and holds the main rod 3. Two openings are cut into squeezing head 2 on two lateral sides of the upper part thereof, allowing the connecting rods 5 to pass through, respectively. On both the front part and the rear part of the squeezing head 2, a left arm 23 and a right arm 24 extend downward, enclosing an opening 27. Through holes 25, 26 are bored through the right and left arms 23, 24, respectively. The through holes 25, 26 have round parts 251, 261 and polygonal parts 252, 262, respectively. The two transverse bars 6 pass through the through holes 25 and 25 of the front and rear parts. The round parts 251, 261 facilitate putting through the smooth sections 62 of the transverse bars 6, and the polygonal parts 252, 262 facilitate putting through the engaging sections 61 of the transverse bars 6. The opening 27 accommodates middle sections of the squeezers 7.

Figure 7:
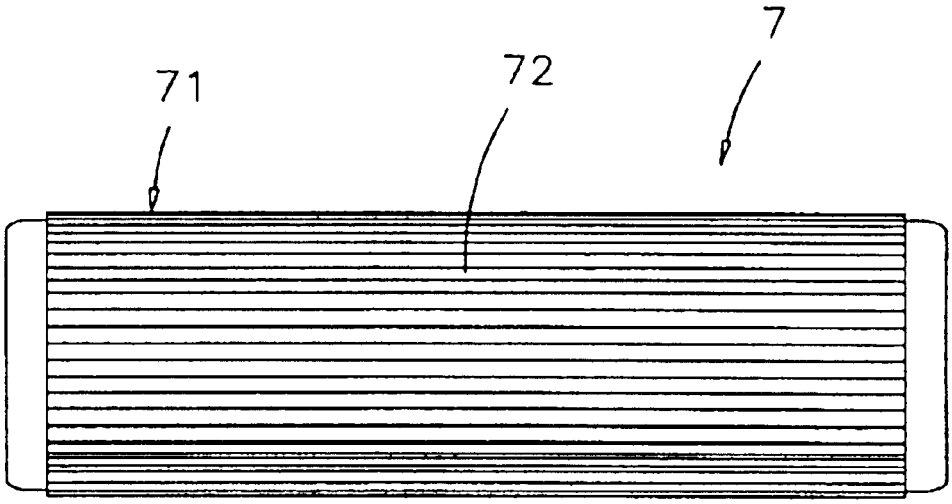
FIG. 7 is a side view of one of the squeezers of the present invention.
Figure 8:
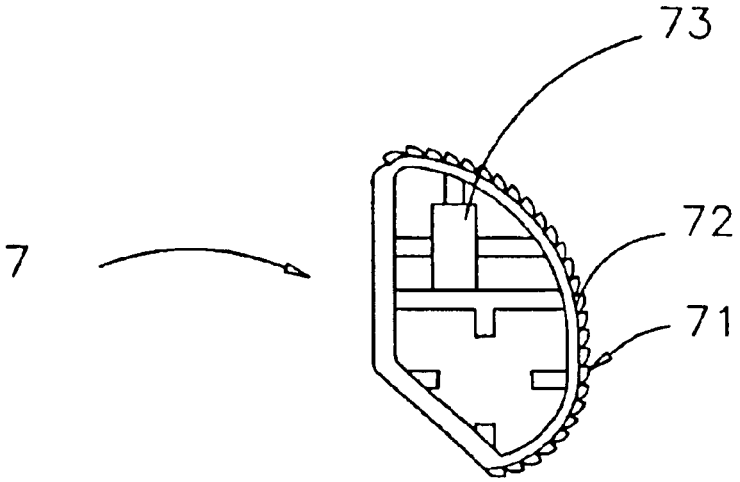
FIG. 8 is a cross-sectional view of one of the squeezers of the present invention.

Referring to FIGS. 7 and 8, each of the squeezers has an oval cross-section with a working surface 71. A plurality of longitudinal ribs 72 protrude from the working surface 71 outward, increasing the total surface, so that squeezing is more effective. Each of the squeezers 7 has a longitudinal canal 73 at an excentric location, through which one of the engaging sections 61 of one of the transverse bars 6 is put. Within each of the squeezers 7, the canal 73 is secured by a stabilizing inner frame. Alternatively, a solid body is substituted for the inner frame. For mounting the squeezers 7, the longitudinal canals 73 thereof are put over the the engaging sections 61 of the transverse bars 6.

Referring again to FIGS. 1 and 2, due to the excentric position of the squeezers 7, the cleaning element 12, when pulled up for wringing and turning the squeezers 7, is squeezed into an ever smaller gap, so that pressure on the cleaning element 12 increases while the cleaning element 12 moves upward. After wringing, the wringing rod 4 is pushed down again, causing the squeezers 7 and the cleaning element 12 to revert to original positions thereof. Repeated pushing upward and downward of the wringing rod 4 completes wringing of the cleaning element 12.

Figure 9:
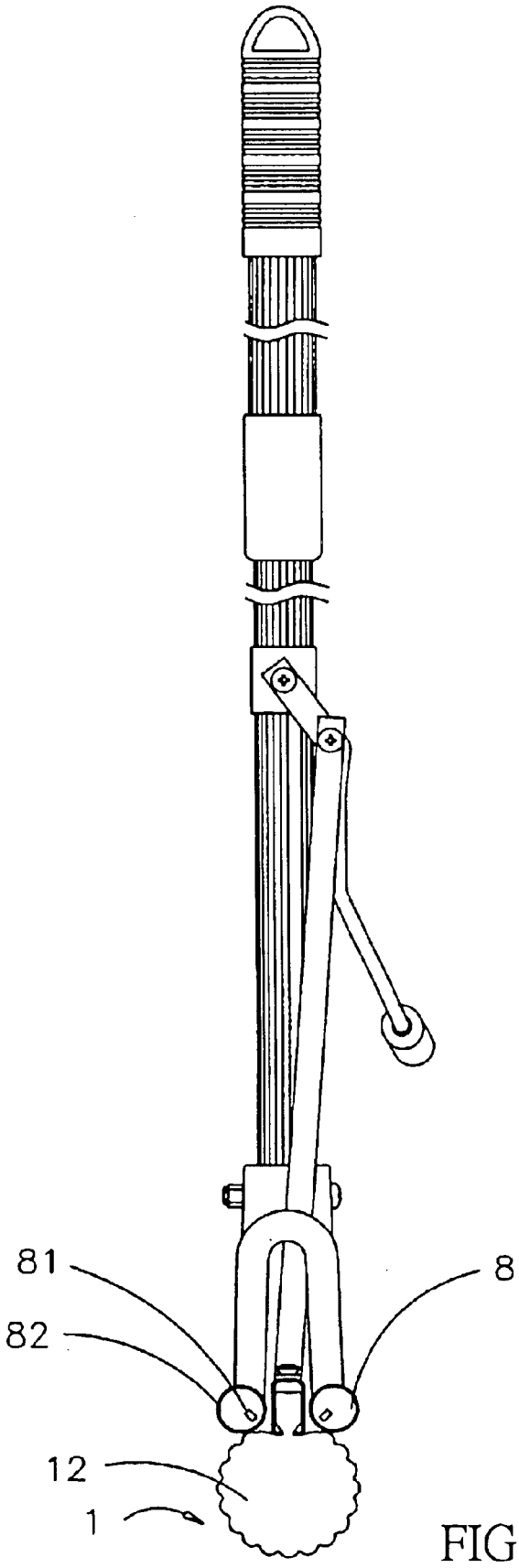
FIG. 9 is a side view of the sweeping and wringing apparatus of the present invention in the second embodiment.
Figure 10:
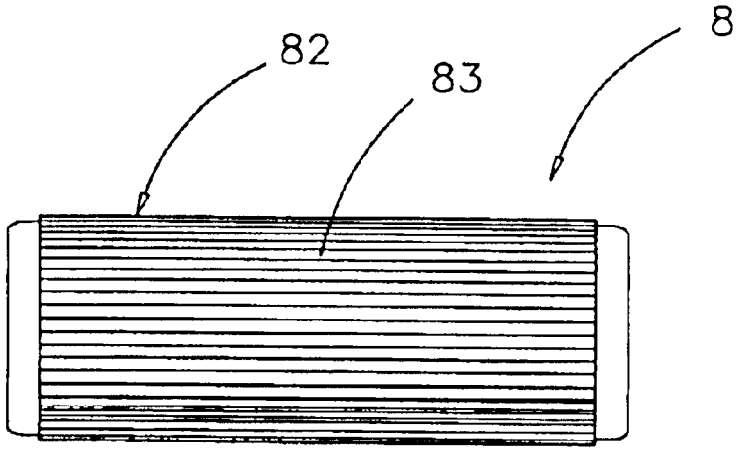
FIG. 10 is a side view of one of the squeezers of the present invention in the second embodiment.
Figure 11:
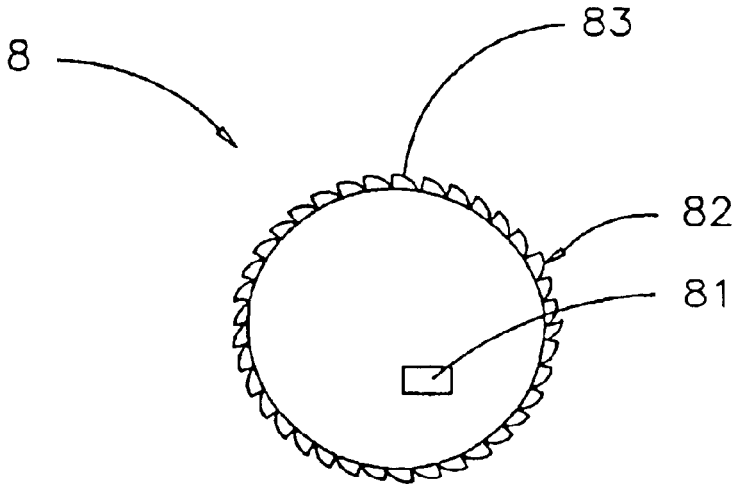
FIG. 11 is a cross-sectional view of one of the squeezers of the present invention in the second embodiment.
Figure 12:
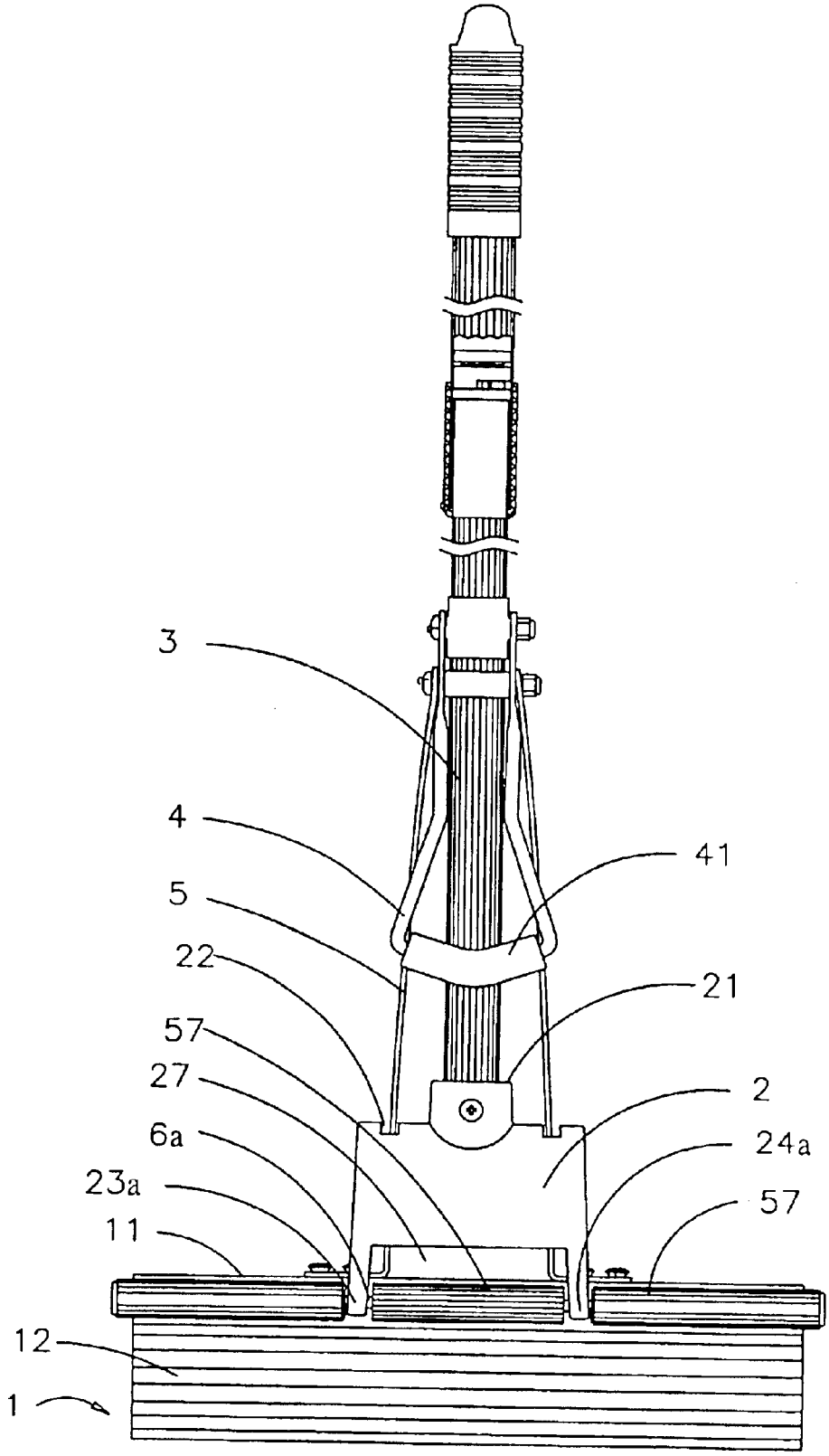
FIG 12 (PRIOR ART)
FIG. 12 (prior art) is a front view of a conventional sweeping and wringing apparatus.
Figure 13:
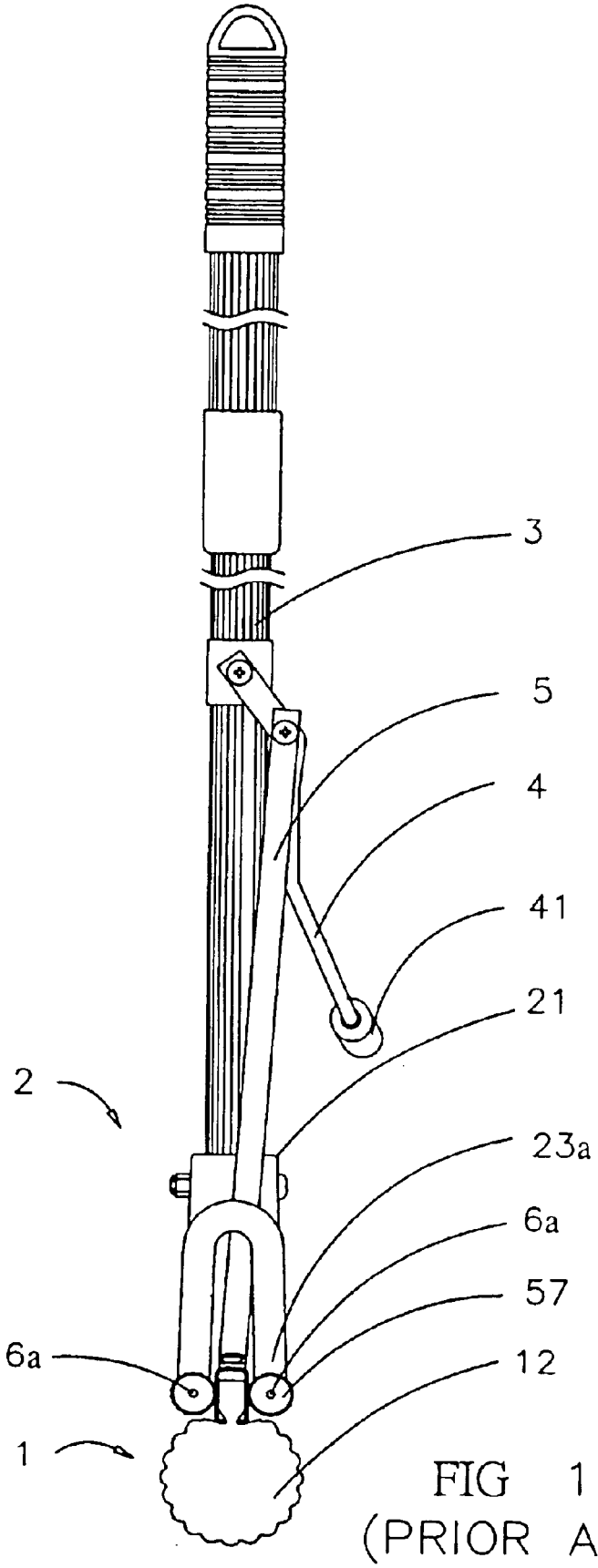
FIG 13 (PRIOR ART)
FIG. 13 (prior art) is a side view of a conventional sweeping and wringing apparatus.

Referring now to FIGS. 9–11, the present invention in a second embodiment has squeezers 8 with circular cross-sections. Each of the squeezers 8 is longitudinally passed through by a canal 81 and has a periphery with a working surface 82 of rounded shape, from which longitudinal ribs 83 protrude outward. For mounting the squeezers 8, the longitudinal canals 81 thereof are put over the the engaging sections 61 of the transverse bars 6.

To summarize, the squeezers of the present invention are excentrically mounted and have working surfaces that are increased by longitudinal ribs. Pressure on the cleaning head becomes larger the farther up the cleaning head is moved, making wringing more effective as well as easier. The cleaning head will thus not be pulled up too far, making it hard to revert to an original shape.

What is claimed is:

1. A sweeping and wringing apparatus, comprising:

a cleaning head, having a cleaning element;

a squeezing head, placed at a lower side of said cleaning head and having a front part and a rear part;

a main rod, mounted on an upper part of said squeezing head;

a wringing rod, shaped like the letter U, having ends that are hingedly connected with said main rod, thus being able to be swayed upward and downward;

two connecting rods, having upper ends that are hingedly connected with said wringing rod and lower ends that pass through said squeezing head and are fastened to said cleaning head;

two transverse bars, respectively mounted on said front part and said rear part at a fixed mutual distance each of said transverse bars has a plurality of engaging sections, each with a rectangular transverse cross-section, and a plurality of gliding sections, with each of said gliding sections placed between two engaging sections, and wherein each of said squeezing sections has a longitudinal canal with a rectangular transverse cross-section which is put over one of said engaging sections; and two squeezers, each having a plurality of aligned squeezing sections which are in equal orientations eccentrically put over one of said two transverse bars, such that pairs of squeezing sections on both of said two transverse bars face each other, with a well-defined gap left in between, each squeezing section further having a working surface with a rounded shape;

wherein, when said cleaning head is pulled up, with said cleaning head passing through said two squeezers, said two squeezers are turned, with said gap in between gradually becoming narrower, so that said cleaning element is effectively wrung.

2. The sweeping and wringing apparatus according to claim 1, wherein each of said squeezing sections has an oval transverse cross-section with an eccentrically placed longitudinal canal.

3. The sweeping and wringing apparatus according to claim 1, wherein each of said squeezing sections has a circular transverse cross-section with an eccentrically placed longitudinal canal.

* * * * *